US007195137B2

(12) United States Patent
Belcastro

(10) Patent No.: US 7,195,137 B2
(45) Date of Patent: Mar. 27, 2007

(54) SELF RETURN TEETER TAUTER LID

(75) Inventor: Domenic Belcastro, Shelby Township, MI (US)

(73) Assignee: Niko Designs, L.L.C., Shelby Township, MI (US)

( * ) Notice: Subject to any disclaimer, the term of this patent is extended or adjusted under 35 U.S.C. 154(b) by 0 days.

(21) Appl. No.: 10/709,879

(22) Filed: Jun. 3, 2004

(65) Prior Publication Data

US 2005/0269325 A1 Dec. 8, 2005

(51) Int. Cl.
*B67D 3/00* (2006.01)

(52) U.S. Cl. ..... 222/484; 220/254.3

(58) Field of Classification Search ..... 220/245.3, 220/361, 710.5, 714, 715, 719, 245.1, 245.9; 222/484, 472, 469, 470, 473
See application file for complete search history.

(56) References Cited

U.S. PATENT DOCUMENTS

| | | | | |
|---|---|---|---|---|
| 2,447,870 A | | 8/1948 | Polcyn | |
| 4,712,704 A | | 12/1987 | Ramsey et al. | |
| 4,750,644 A | * | 6/1988 | Kolody | 222/144.5 |
| 5,036,993 A | | 8/1991 | Ramsey | |
| 5,082,134 A | | 1/1992 | Ramsey | |
| 5,118,014 A | * | 6/1992 | Hestehave et al. | 222/472 |
| 5,186,353 A | | 2/1993 | Ramsey | |
| 5,222,623 A | * | 6/1993 | Eger et al. | 220/715 |
| 5,307,950 A | * | 5/1994 | Li | 220/714 |
| 5,779,102 A | * | 7/1998 | Smith | 222/144.5 |
| 6,098,834 A | * | 8/2000 | Hatsumoto et al. | 220/715 |
| 6,352,166 B1 | * | 3/2002 | Copeland | 220/254.2 |
| 6,886,707 B2 | * | 5/2005 | Giraud | 220/254.4 |

* cited by examiner

*Primary Examiner*—Lien M. Ngo
(74) *Attorney, Agent, or Firm*—John S. Artz; Artz & Artz, P.C.

(57) ABSTRACT

A self-return teeter tauter lid assembly (10) includes a cap (12), a release lever (14) and a spring (16) operatively coupled thereto. The cap (12) has a self-gripping handle (18), a top face (20), a sip and vent ports (22), (24) integrally formed in the top face (20). The release lever (14) is detachably and pivotally coupled to the cap (12) about pivot points (28), (29) and is moveable between a sealed configuration and an unsealed configuration. The release lever (14) has a thumb pad (26) on first side of the pivot point (28), (29) and a sip and vent plugs (30), (32) on a second side of the pivot points (28), (29). The sip and vent plugs (30), (32) seal the sip and vent ports (22), (24) in the sealed configuration. The spring (16) urges the release lever (14) to the sealed configuration, whereby a user applying force between the thumb pad (26) and the self-gripping handle (18) achieves the unsealed configuration.

22 Claims, 3 Drawing Sheets

SELF RETURN TEETER TAUTER LID

BACKGROUND OF INVENTION

The present invention relates generally to drink containers, and more particularly to self return lid assemblies for automatically sealing beverages within drink containers.

There are many types of drink containers in common use today. Users drink from these containers under a wide variety of circumstances in which the beverages are highly susceptible to being unintentionally spilled. These circumstances include, for example, operation of a vehicle, participation in sports, walking, etc. Due to the fluid nature of beverages, spills commonly occur through the open mouths of containers when the containers are jarred, tipped, dropped, or otherwise subjected to sudden movements.

Spills also frequently result from opening sealed drink containers, which have unexpected pressure build-up therein. For example, jarring a sealed container having a carbonated beverage therein typically causes the pressure to increase therein. Subsequently opening the container typically causes the beverage to unexpectedly gush out of the opening due to the pressure build up. Further, sealed containers having hot beverages contained therein may similarly release a small burst of hot steam upon opening the container. Since users obviously wish to prevent accidental spills, it is desirable to prevent the beverage from inadvertently escaping the container without adversely increasing the pressure therein.

One proposal for eliminating accidental spills associated with travel cups employs the use of a thin plastic lid that snaps onto the rim of a Styrofoam or paper cup. These lids are commonly found in fast food restaurants and coffee outlets. The lid typically has perforations to allow a user to form one or more holes allowing the user access to the beverage. By reducing the size of the opening through which the beverage exits the cup, the likelihood of spills is subsequently reduced.

However, these lids fail to eliminate accidental spills because the beverage may still escape through the opening despite its reduced size. For instance, jarring the cup can cause the beverage to splash out of the cup through its opening even though the cup may be in an upright position. This is particularly true when the cup is still relatively full. Moreover, the beverage can still pour out of the cup through the opening if the cup is tipped onto its side. If the cup is dropped, the lid can be dislodged from the cup and the entire contents of the cup can be lost.

Another proposal involves a cup and a lid that is secured to the cup by a threaded engagement. One variation of this proposal further requires a lid having a hole formed therein for the purpose of allowing a straw to pass through the lid. This configuration also includes a cap that is manually placed on the end of the straw to keep the beverage within the cup. Another proposal involves a pop-up vent on the lid which seals the cup when the vent is manually pushed down and permits beverage to exit the cup when the vent is pulled up.

In both proposals, the threaded engagement secures the lid to the cup to prevent the lid from being dislodged from the cup if it is dropped. Both proposals also effectively prevent a beverage from splashing out of the cup if it is jarred when oriented in a substantially upright position. However, unless the user manually places the cap onto the straw or pushes down the pop-up vent, the beverage can spill out of the cup if it is tipped onto its side.

Yet another proposal is a self-sealing closure on a drink container as disclosed in U.S. Pat. No. 5,186,353. Unfortunately, while the closure disclosed therein has improved sealability on its closure, it requires the container to have a handle in order for the user to unseal the closure, which may be undesirable. Further, it requires aligning the lever of the closure with the handle of the container for its proper use. This is disadvantageous in that if these containers are frequently reused, care must be taken to align the lever and handle each time they are reassembled.

Therefore, a need exists for an improved self-sealing closure that is operable independently of the container to which it is attached, and for a closure that when attached to a container eliminates spills while is in a sealed configuration. Also, there is a need for such a closure which eliminates the need to align the lever and handle each time the closure and container are reassembled.

SUMMARY OF INVENTION

One advantage of the present invention is a self-return lid assembly that automatically seals an attached drink container, having a beverage contained therein, so as to prevent accidental spills caused by agitation of the drink container and the beverage.

Another advantage of the present invention is to allow for the operability of a self-return lid assembly independent of its connection to a drink container.

It is still another advantage of the present invention to provide a self-return lid assembly that eliminates the need to align the lid assembly and container each time the lid assembly and container are reassembled.

In accordance with the above advantages of the present invention, a self-return lid assembly for a drinking cup is provided. The self-return lid assembly includes a cap, a release lever and a spring operatively coupled thereto. The cap has a self-gripping handle, a top face, a sip port and a vent port integrally formed in the top face. The release lever is detachably and pivotally coupled to the cap about a pivot point and is moveable between a sealed configuration and an unsealed configuration. The release lever has a thumb pad on first side of the pivot point, and a sip plug and a vent plug on a second side of the pivot point. The sip plug seals the sip port in the sealed configuration. Likewise, the vent plug seals the vent port in the sealed configuration. The spring urges the release lever to the sealed configuration, whereby a user applying force between the thumb pad and the self-gripping handle moves the release handle to the unsealed configuration. The lid assembly may be selectively coupled to a container so as to cover the mouth of the container.

Other advantages of the present invention will become apparent when viewed in light of the detailed description of the preferred embodiment when taken in conjunction with the attached drawings and appended claims.

DETAILED DESCRIPTION

Figure 1:
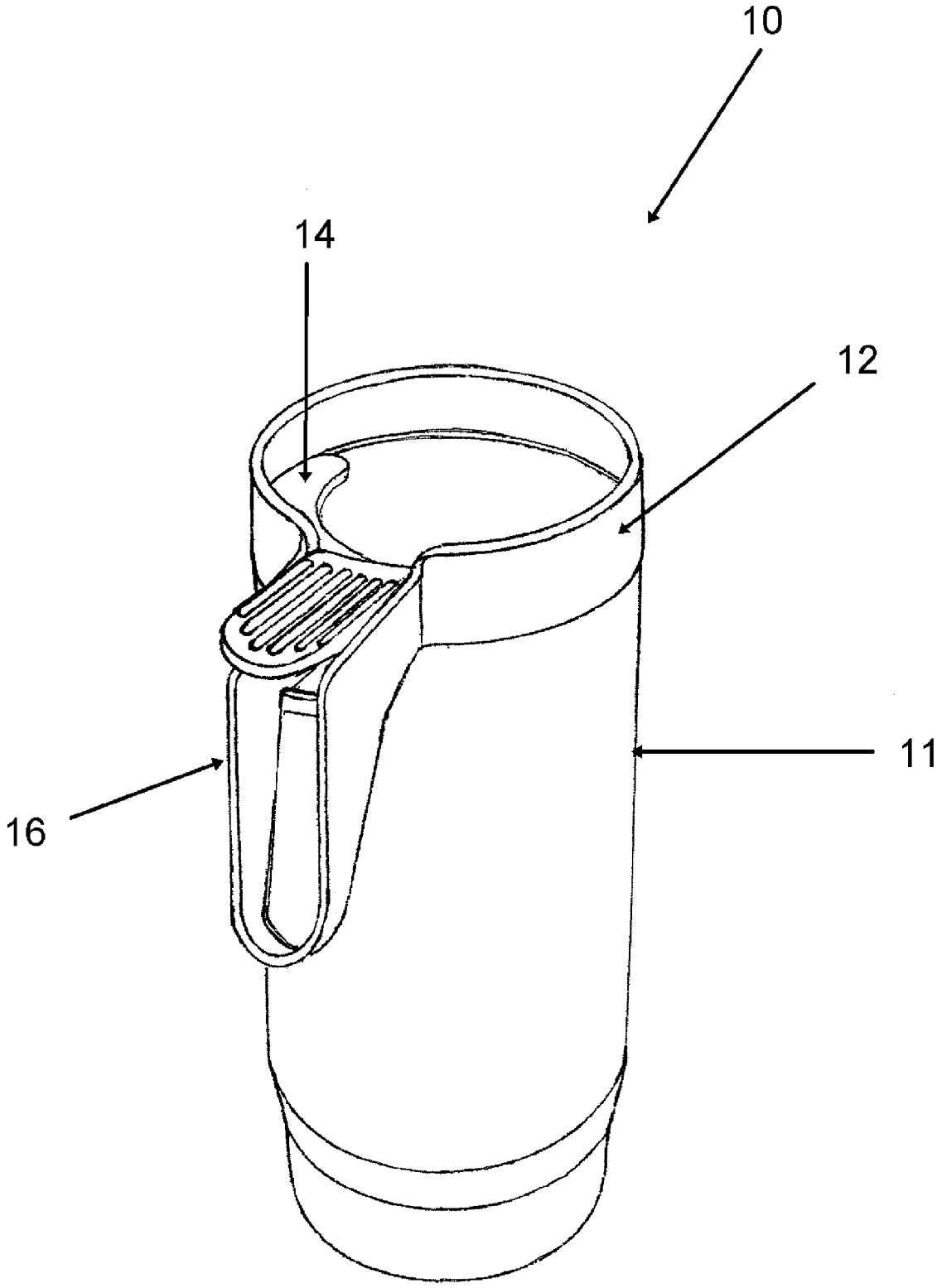
FIG. 1 is a perspective view of a self-return lid assembly attached to a drinking container according to one embodiment of the present invention.

In the following figures, the same reference numerals are used to identify the same components in the various views and alternate embodiments.

Referring now to FIG. 1, there is generally illustrated a perspective view of a self-return lid assembly ("lid assembly") 10 attached to a container 11 according to a preferred embodiment of the present invention. The lid assembly 10 includes a cap 12, a release lever 14, and a spring 16 operatively coupled thereto. The lid assembly 10 is shown in a sealed configuration. The lid assembly 10 may be selectively coupled to any container so as to cover the mouth or opening of the container.

Figure 2:
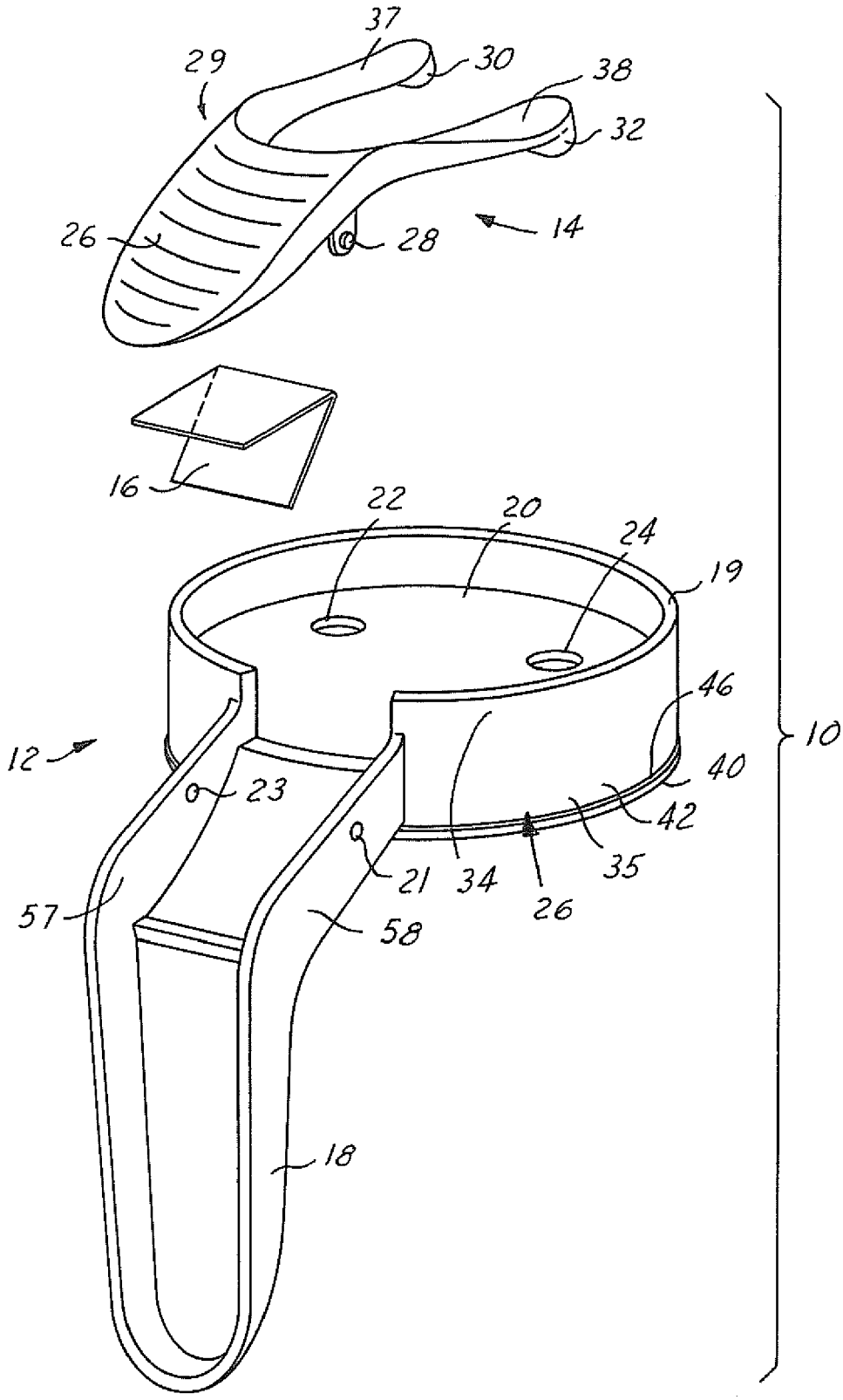
FIG. 2 is an exploded view of a self-return lid assembly according to one embodiment of the present invention.

The lid assembly 10 is best illustrated in FIG. 2, which is an exploded view thereof according to one embodiment of the present invention. The cap 12 has a self-gripping handle 18, a pair of receiving points 21, 23, a top face 20, and sip and vent ports 22, 24 which are integrally formed through the top face 20. The integrally formed ports 22, 24 are intended to permit open communication of a beverage and or gas between the interior and the exterior of the selectively coupled container.

As best shown in FIG. 2, the sip and vent ports 22, 24 are preferably disposed on opposite sides of a centerline of the top face 20. This arrangement provides an efficient flow of air into the interior of the container 11 through the vent port 24 thereby allowing an efficient outflow of the beverage from the interior of the container 11 through the sip port 22 when the lid assembly 10 is disposed in the unsealed configuration. Of course, the cap 12 may have various other types of apertures for permitting the flow of the beverage and the flow of the air between the interior and the exterior of the container 11. Moreover, it will be understood that the sip port 22 and the vent port 24 are interchangeable depending upon from which side of the lid a user is drinking. Therefore, the terms sip port and vent port are used interchangeably herein.

The top face 20 has a circumferential rim 19 about its perimeter from which the self-gripping handle 18 outwardly or peripherally extends. The rim 19 has an upper portion 34 and a lower portion 35. The lower portion 35 of the rim 19 is configured for coupling to the container 11. The upper portion 34 forms a basin with the top face 20 being the floor.

Figure 4:
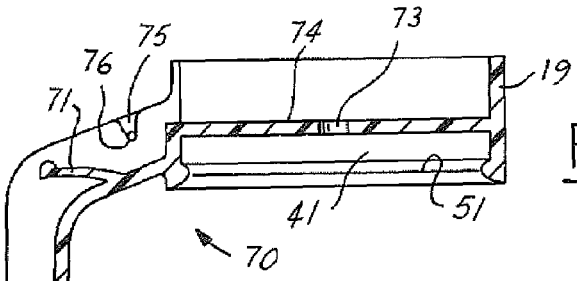
FIG. 4 is a cross-sectional view of a lid according to another embodiment of the present invention.
Figure 7:
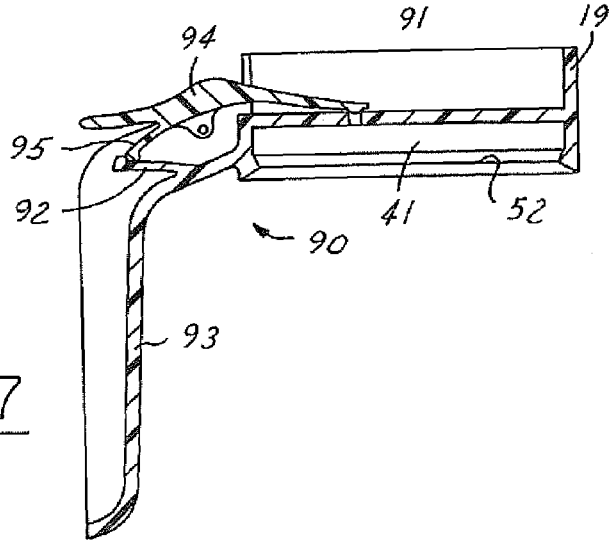
FIG. 7 is a cross-sectional view of a self-return lid assembly according to yet another embodiment of the present invention.

In one embodiment, the lower portion 35 of the rim 19 has a snap-fit fastener 40 integrally formed on its outer surface 26 for attachment to an opposing snap-fit fastener (not shown) of a selectively coupled container 11. The annular flange 46 of the snap-fit fastener 40 engages a groove of the opposing snap-fit fastener so as to provide a detachable snap-fit engagement between the cap 12 and the selectively coupled container 11. This snap-fit engagement allows for attachment of the cap 12 to the selectively coupled container 11 without concern for alignment of the two. Consequently, the face 20 and the rim 19 of the cap 12 may cover the opening of a container and enclose an interior thereof. Of course, various other fastening mechanisms may be used to releasably attach the cap 12 to the container 11. Moreover, a snap-fit fastener 51, 52 may be formed on the inner surface 41 of lower portion 35 of the rim 19 as shown in FIGS. 4 and 7, respectfully.

Figure 6:
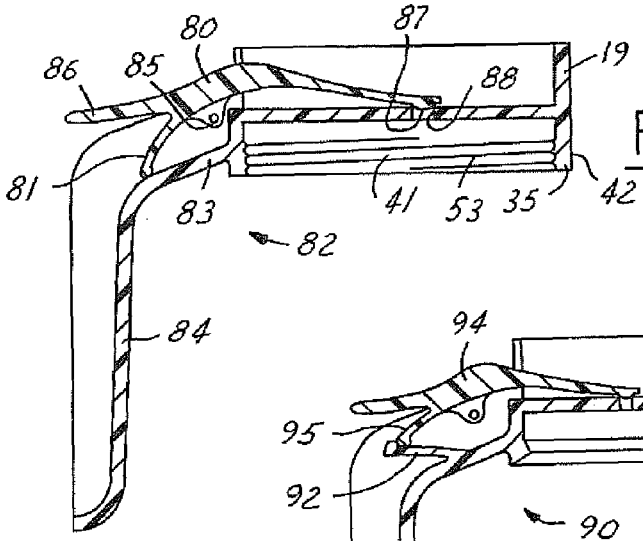
FIG. 6 is a cross-sectional view of a self-return lid assembly according to another embodiment of the present invention.

Alternatively, as shown in FIG. 6, the lower portion 35 of the rim 19 may have a threaded fastener 53 integrally formed on its inner surface 41 for attachment to an opposing threaded fastener (not shown) of the selectively coupled container 11. One of ordinary skill in the art would recognize that the threaded fastener 53 may be alternatively formed on the outer surface 42 of lower portion of the rim 19 of the cap 12 or at the lowermost portion of the cap 12.

Returning to FIG. 2, the self-gripping handle 18 extends outwardly from the rim 19 of the cap 12. One of ordinary skill in the art would recognize that the handle 18 may also extend outwardly and/or downwardly in various other ways to provide a variety of other configurations. The handle 18 is designed to allow a human hand to grip or hold the handle with ease.

The receiving points 21, 23 are located in opposite sides 57, 58 of the handle 18. The receiving points 21, 23 in this embodiment are integrally formed holes through the sides 57, 58 of the handle 18 for coupling the release lever 14 thereto. Optionally, the receiving points 21, 23 may be indentations into the handle or nubs that extend inwardly from the handle. Also, the receiving points 21, 23 may be located near to or at the rim 19 of the cap 12. It will be understood by one of ordinary skill in the art that the receiving points can take on a variety of different configurations and be positioned in a variety of different locations.

The release lever 14 has a pair of pivot points 28, 29, a thumb pad 26 on a first side of the pivot points 28, 29, and sip and vent plugs 30, 32 located on a second side of the pivot points 28, 29. The release lever 14 can be detached from and pivotally coupled to the cap 12. The release lever 14 pivots about pivot points 28, 29 to move between a sealed configuration and an unsealed configuration when coupled to the receiving points 21, 23 of the cap 12.

The pivot points 28, 29 of this embodiment are outwardly extending nubs that are receivable in the holes of the receiving points 21, 23 through a snap-fit engagement. This snap-fit engagement also allows a user to readily detach and re-attach the two portions (the cap 12 and the release lever 14) for a thorough cleaning of the lid assembly 10. Of course, various other arrangements may be employed to pivotally and releasably couple the release lever 14 to the cap 12.

The release lever 14 has sip and vent plugs 30, 32 that distally extend from the end of its forked arms 37, 38 on the second side of the pivot points 28, 29. The sip and vent plugs 30, 32 are integrally formed therein for selectively plugging the sip and vent ports 22, 24, respectively, when the lid assembly 10 is in a sealed configuration. It will be understood by one of ordinary skill in the art that the plugs 30, 32 may take on a variety of different configurations, including multiple pieces.

The spring 16 is compressively coupled between the release lever 14 and the cap 12 but is not attached to either structure. In one embodiment, the spring 16 consists of a bent plate having a restoring force when it is compressed between the release lever 14 and the cap 12. The spring 16 biases the vent plugs 30, 32 into engagement with the sip and vent ports 22, 24. One of ordinary skill in the art will recognize that the spring may be any other type of spring that has a restoring force when compressed and is capable of maintaining the release lever 14 and cap 12 in a sealed configuration when released. In an alternate embodiment, the spring 16 may be retained in an assembled position upon a shaft 17 aligned with the pivot points 28, 29 and coupled to the receiving points 21, 23. As shown, the spring 16 as well as the pivot points are located outwardly from the rim 19.

The spring 16 urges the release lever 14 to the sealed configuration. By applying an actuating force between the thumb pad 26 and the self-gripping handle 18, a user can move the release lever 14 to the unsealed configuration. The spring 16 exerts a restoring force between the release lever 14 and the cap 12. As a result, the spring 16 operatively causes the release lever 14 to rotate about its pivot points 28, 29 thereby engaging the sip and vent plugs 30, 32 with the sip and vent ports 22, 24 respectively. Thus, the spring 16 urges the lid assembly 10 to the sealed configuration. In the sealed configuration, plugs 30, 32 seal the ports 22, 24 preventing fluid from escaping therefrom.

To overcome the sealed configuration, an actuating force is exerted which must be greater than the restoring force to permit the release lever 14 to rotate. As the release lever 14 rotates in reaction to the actuating force, the sip and vent plug 30, 32 are simultaneously removed from the sip and vent ports 30, 32, respectively.

Figure 3:
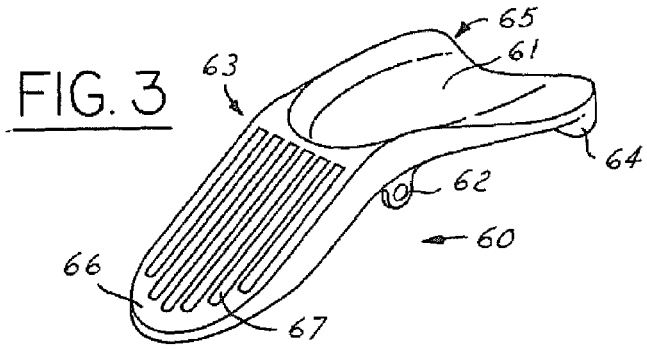
FIG. 3 is a perspective view of a release lever for a self-return lid assembly according to another embodiment of the present invention.

FIG. 3 is a perspective view of a release lever 60 according to another embodiment of the present invention. The release lever 60 shown has a crescent shape on the second side of the pivot points 62, 63 and the sip and vent plugs 64, 65 are integrally attached thereto. The pivot points 62, 63 form holes for receiveably being attached to the cap of the present invention. The pivot points 62, 63 may be engaged by a pin, nub, or shaft for attachment to a cap. Obviously, one of ordinary skill in the art will recognize that the attachment of the release lever 60 to the cap may be accomplished in a variety of other ways. The thumb pad 66 of this embodiment is shown having vertical ridges 67.

FIG. 4 is a cross-sectional view of a cap 70 according to another embodiment of the present invention. The cap 70 has an integrally formed spring 71 extending from its handle 72. The integrally formed spring 71 has the same operative effect upon the lid assembly as the spring mentioned above in FIG. 2. Also, the receiving point 76 communicates with a groove 75 in the handle 72 of the cap 70 for a pivot point of the release lever to be slideably received in the receiving point 76. Sip port 73 is shown in the top face 74 of the cap 70.

Figure 5:
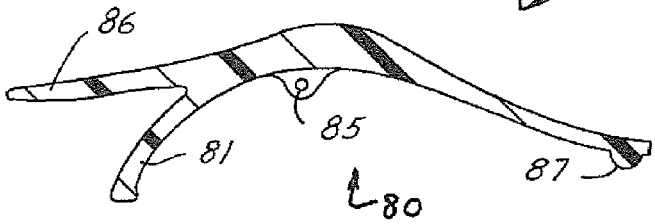
FIG. 5 is a cross-sectional view of a release lever for a self-return lid assembly according to another embodiment of the present invention.

FIG. 5 is a cross-sectional view of a release lever 80 according to yet another embodiment of the present invention. The release lever 80 has an integrally formed spring 81 extending therefrom. The integrally formed spring 81 has the same operative effect upon the lid assembly as the spring mentioned above in FIG. 2.

FIG. 6 is a cross-sectional view of a self-return lid assembly 82 according to another embodiment of the present invention. This embodiment shows the release lever 80 of FIG. 5 assembled to the cap 83. The spring 81 exerts a restoring force on the handle 84 of the cap 83, which causes the release lever 80 to rotate about its pivot point 85 into the sealed configuration. As mentioned above, an activating force must be applied on the pad 86 of the release lever 80 overcoming the restoring force in order to rotate the release lever 80 into an unsealed configuration. Also, the vent plug 87 is shown in the sealed configuration sealing the vent port 88.

FIG. 7 is a cross-sectional view of a self-return lid assembly 90 according to another embodiment of the present invention. The cap 91 has an integrally formed spring 92 extending from its handle 93. Also, the release lever 94 has an integrally formed spring 95 extending therefrom. The springs 92, 95 compressively engage one another on the lid assembly 90. The integrally formed springs 92, 95 have the same operative effect upon the lid assembly as the spring mentioned above in FIG. 2.

While particular embodiments of the invention have been shown and described, numerous variations and alternate embodiments will occur to those skilled in the art. Accordingly, it is intended that the invention be limited only in terms of the appended claims.

The invention claimed is:

1. A self return lid assembly for selectively sealing a container comprising:

a cap having a self-gripping handle, a top face, a sip port and a vent port integrally formed in the top face, and a generally circular outer peripheral rim;

a release lever detachably pivotally coupled to said cap about a pivot point and moveable between a sealed configuration and an unsealed configuration, said pivot point being disposed outside said generally circular outer peripheral rim, said release lever having a thumb pad on a first side of the pivot point and a sip plug and a vent plug on a second side of the pivot point, the second side of said release lever is fork-shaped having two arms, wherein the vent plug and the sip plug each extend from the distal end of one of each arm, and the sip plug sealing the sip port independently of the vent plug sealing the vent port in said sealed configuration; and a biasing mechanism operatively coupled to said cap and said release lever, said biasing mechanism urging said release lever to said sealed configuration through application of an upward force on an underside of said release lever, whereby said unsealed configuration is achieved by applying force between the thumb pad and the self-gripping handle.

2. The self return teeter tauter lid assembly as recited in claim 1 further comprising a container having a container opening coupled to said cap, wherein said cap selectively coupled to said container so as to cover said container opening.

3. The self return teeter tauter lid assembly as recited in claim 1, wherein said outer peripheral rim has an upper portion and a lower portion, the upper portion forming a basin in said sealed configuration with the top face, and the lower portion configured for coupling to a container.

4. The self return teeter tauter lid assembly as recited in claim 3 wherein the lower portion configured having a detachable snap-fit engagement for coupling to a container.

5. The self return teeter tauter lid assembly as recited in claim 1 wherein the sip port permits a fluid to pass there through in said unsealed configuration, the vent port permits a gas to pass there through in said unsealed configuration.

6. The self return teeter tauter lid assembly as recited in claim 1 wherein said release lever having protruding pins at the pivot point is slideably receivable in the pin holes of the grooves integrally formed in the self-gripping handle.

7. The self return teeter tauter lid assembly as recited in claim 1 wherein the fork-shaped second side of said release lever is substantially crescent-shaped.

8. The self return teeter tauter lid assembly as recited in claim 1 wherein said biasing mechanism includes a spring, and said release lever comprises a shaft aligning the pivot point and retaining the spring in an assembled position.

9. A self return teeter tauter lid assembly for selectively sealing a container comprising:

a cap having a self-gripping handle, a top face, an outer peripheral rim, a sip port and a vent port integrally formed in the top face; and a release lever detachably pivotally coupled to said cap about a pivot point and moveable between a sealed configuration and an unsealed configuration, said release lever having integrally formed therein: a spring, a thumb pad on a first side of the pivot point and a sip plug and a vent plug on a second side of the pivot point; the sip plug sealing the sip port in said sealed configuration, the vent plug sealing the vent port In said sealed configuration; the integral spring of said release lever resiliently engages said cap, wherein the spring urges said release lever to said sealed configuration through application of an upward force on an underside of said release lever, whereby said unsealed configuration is achieved by applying force between the thumb pad and the self-gripping handle;

wherein said pivot point is disposed outwardly said outer peripheral rim of said cap.

10. The self return teeter tauter lid assembly as recited in claim 9 further comprising a container having a container opening coupled to said cap, wherein said cap selectively coupled to said container so as to cover said container opening.

11. The self return teeter tauter lid assembly as recited in claim 9 having a rim encompassing the outer perimeter of the top face and the self-gripping handle extending peripherally therefrom, wherein the rim has an upper portion and a lower portion, the upper portion forming a basin in said sealed configuration with the top face, and the lower portion configured for coupling to a container.

12. The self return teeter tauter lid assembly as recited in claim 11 wherein the lower portion configured having a detachable snap-fit engagement for coupling to a container.

13. The self return teeter tauter lid assembly as recited in claim 9 wherein the sip port permits a fluid to pass there through in said unsealed configuration, the vent port permits a gas to pass there through in said unsealed configuration.

14. The self return teeter tauter lid assembly as recited in claim 9 wherein said release lever having protruding pins at the pivot point is slideably receivable in the pin holes of the grooves integrally formed in the self-gripping handle.

15. The self return teeter tauter lid assembly as recited in claim 9 wherein the second side of said release lever is fork-shaped having two arms, wherein the vent plug and the sip plug are coupled to the distal end of each arm.

16. A self return teeter tauter lid assembly for selectively sealing a container comprising:

a cap, said cap having integrally formed therein: a spring, a self-gripping handle, a top face, a sip port and a vent port integrally formed in the top face;

a release lever detachably pivotally coupled to said cap about a pivot point, which is disposed beyond an outer periphery of said top face and moveable between a sealed configuration and an unsealed configuration, said release lever having a thumb pad on a first side of the pivot point and a sip plug and a vent plug on a second side of the pivot point; the sip plug sealing the sip port in said sealed configuration, the vent plug sealing the vent port in said sealed configuration; the integral spring of said cap resiliently engages said release lever, wherein the spring urges said release lever to said sealed configuration, whereby said unsealed configuration is achieved by applying force between the thumb pad and the self-gripping handle.

17. The self return teeter tauter lid assembly as recited in claim 16 further comprising a container having a container opening coupled to said cap, wherein said cap selectively coupled to said container so as to cover said container opening.

18. The self return teeter tauter lid assembly as recited in claim 16 having a rim encompassing the outer perimeter of the top face and the self-gripping handle extending peripherally therefrom, wherein the rim has an upper portion and a lower portion, the upper portion forming a basin in said sealed configuration with the top face, and the lower portion configured for coupling to a container.

19. The self return teeter tauter lid assembly as recited in claim 18 wherein the lower portion configured having a detachable snap-fit engagement for coupling to a container.

20. The self return teeter tauter lid assembly as recited in claim 16 wherein the sip port permits a fluid to pass there through in said unsealed configuration, the vent port permits a gas to pass there through in said unsealed configuration.

21. The self return teeter tauter lid assembly as recited in claim 16 wherein said release lever having protruding pins at the pivot point is slideably receivable in the pin holes of the grooves integrally formed in the self-gripping handle.

22. The self return teeter tauter lid assembly as recited in claim 16 wherein the second side of said release lever is fork-shaped having two arms, wherein the vent plug and the sip plug are coupled to the distal end of each arm.

* * * * *

UNITED STATES PATENT AND TRADEMARK OFFICE

CERTIFICATE OF CORRECTION

PATENT NO. : 7,195,137 B2
APPLICATION NO. : 10/709879
DATED : March 27, 2007
INVENTOR(S) : Domenic Belcastro It is certified that error appears in the above-identified patent and that said Letters Patent is hereby corrected as shown below:

In the Claims:

Claim 9:
Column 7, Line 13, should read as follows: --ration, the vent plug sealing the vent port in said sealed--

Signed and Sealed this

Twenty-second Day of May, 2007

JON W. DUDAS
*Director of the United States Patent and Trademark Office*